US011434447B2

(12) United States Patent
Kolekar et al.

(10) Patent No.: US 11,434,447 B2
(45) Date of Patent: *Sep. 6, 2022

(54) SILICONE MODIFIED LUBRICANT

(71) Applicants: Valvoline Licensing and Intellectual Property, LLC, Lexington, KY (US); Imperial Innovations Limited, London (GB)

(72) Inventors: Anant S. Kolekar, Lexington, KY (US); Andrew V. Olver, Reading (GB); Adam E. Sworski, Catlettsburg, KY (US); Frances E. Lockwood, Georgetown, KY (US); Gefei Wu, Lexington, KY (US); Xiurong Cheng, Lexington, KY (US)

(73) Assignees: Valvoline Licensing and Intellectual Property, LLC, Lexington, KY (US); Imperial Innovations Limited, London (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/155,378

(22) Filed: May 16, 2016

(65) Prior Publication Data

US 2016/0257906 A1 Sep. 8, 2016

Related U.S. Application Data

(63) Continuation-in-part of application No. 14/548,850, filed on Nov. 20, 2014, now Pat. No. 10,323,207.
(Continued)

(51) Int. Cl.
*C10M 169/04* (2006.01)
*C10M 101/02* (2006.01)
(Continued)

(52) U.S. Cl.
CPC ..... *C10M 169/044* (2013.01); *C10M 101/02* (2013.01); *C10M 125/02* (2013.01);
(Continued)

(58) Field of Classification Search
CPC ..... C10M 2201/041; C10M 2229/041; C10M 169/044; C10M 101/02; C10M 155/02;
(Continued)

(56) References Cited

U.S. PATENT DOCUMENTS 3,629,120 A * 12/1971 Fairing ..... C10M 3/00 252/77
3,748,372 A 7/1973 McMahon et al.
(Continued)

FOREIGN PATENT DOCUMENTS

EP 2107063 A1 10/2009
JP H01095193 A 4/1989
(Continued)

OTHER PUBLICATIONS

Search Report and Written Opinion from corresponding PCT application PCT/US2014/06663, dated Apr. 8, 2015 (10 pages).
(Continued)

*Primary Examiner* — Vishal V Vasisth
(74) *Attorney, Agent, or Firm* — Wood Herron & Evans LLP

(57) ABSTRACT

A silicone modified lubricant includes a Group I, II, III, IV or V base oil in combination with a minor amount of a silicone oil. Further, the lubricant includes a dispersant such as a dispersant olefin copolymer which maintains the silicone oil dispersed in the base oil. The silicone oil reduces the surface tension of the lubricant thereby reducing power loss. Preferably the lubricant formation has a surface tension less than 28 mN/m, making it particularly suitable for dip lubrication systems.

17 Claims, 2 Drawing Sheets

Related U.S. Application Data

(60) Provisional application No. 61/907,661, filed on Nov. 22, 2013.

(51) Int. Cl.

| | |
|---|---|
| ***C10M 155/02*** | (2006.01) |
| ***C10M 143/00*** | (2006.01) |
| ***C10M 125/02*** | (2006.01) |
| ***F01M 9/06*** | (2006.01) |
| *C10N 30/00* | (2006.01) |
| *C10N 20/00* | (2006.01) |
| *C10N 20/02* | (2006.01) |
| *C10N 20/06* | (2006.01) |
| *C10N 30/06* | (2006.01) |
| *C10N 40/04* | (2006.01) |

(52) U.S. Cl.

CPC ..... *C10M 143/00* (2013.01); *C10M 155/02* (2013.01); *C10M 169/04* (2013.01); *C10M 169/041* (2013.01); *F01M 9/06* (2013.01); *C10M 2201/041* (2013.01); *C10M 2203/1006* (2013.01); *C10M 2203/1025* (2013.01); *C10M 2205/02* (2013.01); *C10M 2205/0285* (2013.01); *C10M 2229/02* (2013.01); *C10N 2020/01* (2020.05); *C10N 2020/02* (2013.01); *C10N 2020/06* (2013.01); *C10N 2030/00* (2013.01); *C10N 2030/06* (2013.01); *C10N 2030/54* (2020.05); *C10N 2040/04* (2013.01)

(58) Field of Classification Search

CPC ..... C10M 143/00; C10M 125/02; C10M 2229/02; C10M 2205/02; C10N 2030/00; C10N 2040/04

USPC ..... 508/126, 208

See application file for complete search history.

(56) References Cited

U.S. PATENT DOCUMENTS

| | | | | |
|---|---|---|---|---|
| 4,160,739 | A | 7/1979 | Stambaugh et al. | |
| 4,224,173 | A | 9/1980 | Reick | |
| 5,047,159 | A * | 9/1991 | Zehler | C10M 155/02 508/208 |
| 5,320,761 | A | 6/1994 | Hoult et al. | |
| 5,583,095 | A * | 12/1996 | Kobayashi | C10M 107/00 508/207 |
| 6,372,696 | B1 | 4/2002 | Tipton | |
| 6,503,871 | B2 | 1/2003 | Martin | |
| 6,955,472 | B2 | 10/2005 | Rudd et al. | |
| 7,045,055 | B2 | 5/2006 | Ziemer et al. | |
| 7,425,524 | B2 | 9/2008 | Haire et al. | |
| 7,449,432 | B2 | 10/2008 | Lockwood et al. | |
| 7,732,389 | B2 | 6/2010 | Sullivan et al. | |
| 2003/0086203 | A1 | 5/2003 | Khan | |
| 2004/0259742 | A1 * | 12/2004 | Mishra | C10M 135/28 508/231 |
| 2006/0189490 | A1 * | 8/2006 | Dardin | C10M 151/02 508/469 |
| 2006/0264339 | A1 | 11/2006 | Devlin et al. | |
| 2007/0000807 | A1 * | 1/2007 | Wu | C10M 107/02 208/18 |
| 2008/0242566 | A1 * | 10/2008 | Lockwood | B82Y 30/00 508/113 |
| 2008/0248983 | A1 | 10/2008 | Goyal et al. | |
| 2011/0067957 | A1 | 3/2011 | Boccaletti et al. | |
| 2011/0166052 | A1 | 7/2011 | Hee et al. | |
| 2011/0190183 | A1 | 8/2011 | Miyamoto et al. | |
| 2012/0064022 | A1 * | 3/2012 | Wray | C08L 83/14 424/70.12 |
| 2014/0048354 | A1 | 2/2014 | Kolekar et al. | |
| 2014/0066631 | A1 | 3/2014 | Kwon et al. | |

FOREIGN PATENT DOCUMENTS

| | | | |
|---|---|---|---|
| JP | H08127787 | A | 5/1996 |
| JP | H11132318 | A | 5/1999 |
| JP | H11209778 | A | 8/1999 |
| JP | 2006241443 | A | 9/2006 |
| JP | 2007170540 | A | 7/2007 |

OTHER PUBLICATIONS

The Efficiency of a Hypoid Axle—A Thermally Coupled Lubrication Model by AS Kolekar et al. Tribology International (2012) 7 pages.

* cited by examiner

SILICONE MODIFIED LUBRICANT

CROSS-REFERENCE TO RELATED APPLICATION

This application is a CIP of Ser. No. 14/548,850, filed Nov. 20, 2014, now patent Ser. No. 10/323,207 which claims benefit of 61/907,661, filed Nov. 22, 2013.

STATEMENT REGARDING FEDERALLY SPONSORED RESEARCH OR DEVELOPMENT

The present invention was made with government support under Contract No. DE EE0006427, awarded by the Department of Energy. The U.S. Government has certain rights in the present invention.

BACKGROUND OF THE INVENTION

Hydrocarbon oils are suitable for a wide variety of different applications and are particularly characterized by low cost and excellent resistance to acid and alkali. Hydrocarbon oils are widely used as base stocks for various lubricant formulations.

Silicone oil, such as dimethyl polysiloxane, provides low surface tension and excellent resistance to heat and cold. However, silicone oils are expensive, which, in turn, has limited their application in the past. Most attempts to blend silicone oils with hydrocarbon oils have been unsuccessful because the two components are inherently incompatible and separate over time.

SUMMARY OF THE INVENTION

The present invention is premised on the realization that a lubricant can be formulated by combining a Group I-Group V base oil, with silicone oil and further incorporating a dispersant such as an dispersant olefin copolymer in an amount effective to maintain the silicone oil dispersed in the base stock. The dispersant olefin copolymer can, for example, be an ethylene propylene copolymer, which has an ethylene/propylene ratio of 55/45-45/55. Other dispersant olefin copolymers, such as ethylene propylene diene terpolymers, can also be used.

The objects and advantages of the present invention will be further appreciated in light of the following detailed description and drawings in which:

DETAILED DESCRIPTION OF THE INVENTION

Figure 1:
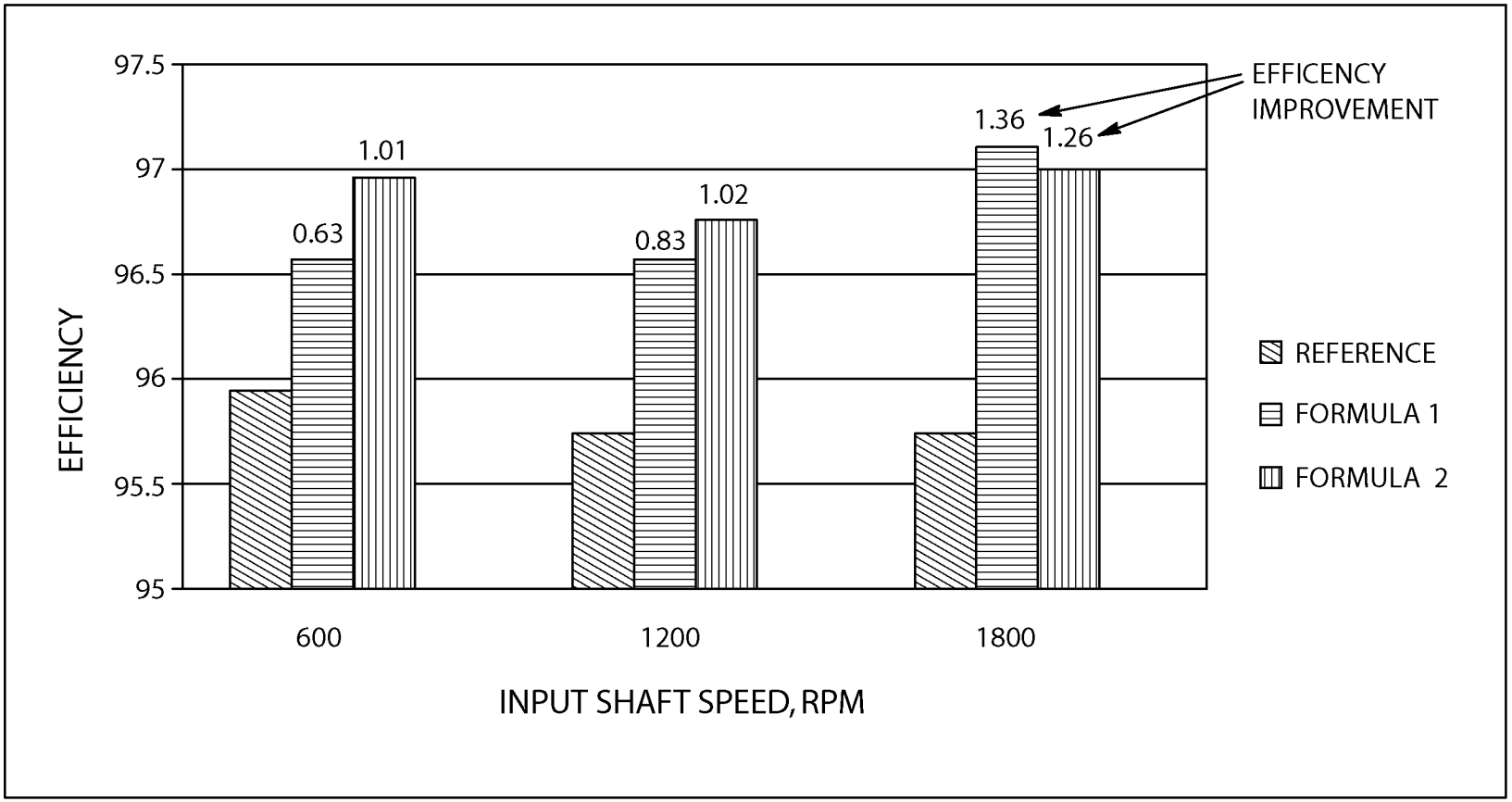
FIG. 1 is a chart showing the efficiency comparison of formulations of the present invention versus a standard formulation.

A lubricant, according to the present invention, includes one or more base oils in combination with silicone oil as well as an additive package. In general, the lubricant of the present invention will have a lower surface tension than the base oil or the standard formulation. For use in the present invention, the lubricant will have a surface tension of less than 28 mN/m, 27 mN/m, such as 25 mN/m or lower.

Further, the viscosity of the lubricant should preferably be less than 400 mPa-sec at 25° C. (less than about 500 cSt @ 25° C.).

The base oil is generally at least 40% of the total weight of the lubricant. The base oil is one or more of a Group I, Group II, Group III, Group IV or Group V base oils excluding silicone oil (as designated by the American Petroleum Institute (API)). The base oil should have a viscosity of 2-100 cSt at 100° C., and preferably a viscosity index of at least 80 preferably above 120 or higher, such as 150. Groups I and II base oils are commonly used as gear oils in certain geographic regions, while Group III and Group IV base oils are used in other regions.

Group I base oils are solvent refined mineral oils and Group II are hydrotreated mineral oils. Group III base stocks are made by hydrogenation during which a mineral oil is subjected to hydrogenation or hydrocracking under special conditions to remove undesirable chemical compositions and impurities, resulting in a mineral oil based oil having synthetic oil components and properties. Typically the hydrogenated oil defined as Group III is petroleum-base stock with a sulfur level less than 0.03, severely hydrotreated and iso-dewaxed, with saturates greater than or equal to 90 and a viscosity index greater than or equal to 120.

The Group IV base oils are polyalphaolefins. PAOs are formed by the polymerization or co-polymerization of alphaolefins having 2 to 32 carbons. More typically, C8, C10, C12, C14 olefins or mixtures thereof. Group I-IV base stocks are all hydrocarbon based.

Group V base oils are classified as all base oils other than Group I, II, III and IV. Examples include phosphate esters, polyalkylene glycol (PAG), polyolesters, biolubes, etc. Mainly these base stocks are mixed with other base stocks to enhance the oil performance. Esters are common Group V base oils used in different lubricant formulations including engine and gear oils. Ester oils improve performance at higher temperatures and will increase drain intervals by providing superior detergency compared to PAO synthetic base oil. For purposes of the present invention, silicone oil, which is typically classified as a Group V oil, is not used as the base oil in the present invention.

For use in the present invention, the lubricant will comprise 40 to about 95% of the base oil with the additive package, silicone oil as well as any other additives being 5 to 60% by weight.

In addition to the base oil, the lubricant of the present invention will include 0.01 to about 5 wt % of silicone oil. Silicone oils are semi-organic polymers comprising chains of silicon and oxygen atoms (polysiloxanes) modified with various organic groups attached to the silicon atoms. Generally, silicones have repeating silicon/oxygen units making up the majority and generally 60%, 70%, 80%, 90% or more of the backbone of the polymer. An exemplary silicone oil is dimethyl polysiloxane.

Silicone oil acts to reduce surface tension and, in combination with Group III base oils, reduces the coefficient of friction. The silicone oil can be used in amounts from about 0.01 to about 5%, 0.02 to about 0.5%, 0.1 to 0.5% with good results achieved at 0.2% silicone oil based on the total weight of the lubricant. A wide range of different viscosities can be used, including 10, 20, 50, 100, 350, 1000, 5000, 10,000 and 60,000 centistokes at 25° C. Commercially available silicone oils include Xiameter PMX-0245, Dow Corning 200 and 510. Silicone oil Dow Corning 200 is described in U.S. Pat. No. 7,273,837 as polydimethylsiloxane. U.S. Pat. No. 8,592,376 states that Dow Corning Xiameter PMX-0245 is cyclopentasiloxane. U.S. Pat. No.

5,789,340 states that Dow-Corning 510 Silicone Fluid is a mixture of dimethyl and methyl phenyl siloxanes. The higher viscosity silicone oils reduce friction, but tend to separate more readily from the base oil. Lower viscosity silicone oils disperse more easily in the base oil. Therefore, viscosities of 10-350 cSt are advantageous, particularly 10-50 cSt at 25° C.

Further, the lubricant formulation of the present invention will include a dispersant effective to maintain the silicone oil dispersed in the base stock. Generally, these will be dispersant olefin copolymers. These copolymers include a backbone or substrate polymer which is substantially linear and saturated, i.e. having less than 4, preferably less than 2, mole percent olefinic unsaturation. Typical backbone polymers include ethylene propylene copolymers, ethylene propylene diene modified terpolymers, hydrogenated styrene butadiene copolymers and styrene isoprene copolymers. These polymers can be grafted with the various groups, such as maleic anhydride as disclosed in U.S. Pat. No. 4,160,739, the disclosure of which is incorporated herein by reference. Amine groups can be added, bonded to the maleic anhydride to improve solubility.

In particular, the ethylene propylene copolymers are particularly useful in the present invention. These will generally have an ethylene propylene ratio, which permits them to dissolve in the base stock. Generally, when the ethylene content is 80 mole percent or higher, it tends to become crystalline and lose its oil solubility. More useful ethylene propylene polymers contain 45 to 70 mole percent ethylene, with 30-55% propylene. Generally, if a diene is incorporated into the ethylene propylene copolymer, it will be in less than about 10% of the molecule. Conjugated dienes, such 1,4-hexadiene and dicyclopentadiene are typically used.

One particular dispersant olefin copolymer suitable for use in the present invention is Hitec 5777. This will generally be added to the formulation in an amount from about 0.1 to about 2%, generally 0.5 to about 2%, and typically about 1% based on the total weight of the lubricant formulation. Additional Hitec 5777 can also be added as a viscosity index improver or as a dispersant if necessary, which can bring the total content up to 10%.

In addition to the base oil and the silicone oil, the lubricant of the present invention can include nanographite particles. Typical nanographite particles are disclosed in U.S. Pat. No. 7,449,432, the disclosure of which is hereby incorporated by reference. Generally, the graphite nanoparticles will have a mean particle size less than 500 nm in diameter, preferably less than 100 nm and most preferably less than 50 nm. These can be present in amounts from 0% to 15% by weight, such as 0.01 to 10% by weight, or 0.1% to 5% by weight nanoparticles. The graphite nanoparticles provide thermal conductivity and lubricity improvements to the lubricant formulation. These can be manufactured either by a dry method or wet method, as is well known, and can be purchased from Acheson, U-Car Carbon Company, Inc. and Cytec Carbon Fibers LLC.

Viscosity improvers used in the lubricant industry can be used in the instant invention for the purpose of achieving additional thickening. These include olefin copolymers (OCP), polymethacrylates (PMA), hydrogenated styrene-diene (STD), and styrene-polyester (STPE) polymers.

Chemical compounds such as seal swell agents or plasticizers can also be used, such as phthalates, adipates, sebacate esters, and more particularly: glyceryl tri(acetoxystearate), epoxidized soybean oil, epoxidized linseed oil, N,n-butyl benzene sulfonamide, aliphatic polyurethane, epoxidized soy oil, polyester glutarate, polyester glutarate, triethylene glycol caprate/caprylate, long chain alkyl ether, dialkyl diester glutarate, monomeric, polymer, and epoxy plasticizers, polyester based on adipic acid, hydrogenated dimer acid, distilled dimer acid and polymerized fatty acid trimer.

Antioxidants are an important part of transmission fluids. General classes include zinc dialkyldithiophosphates, alkyl and aryl phenols, alkyl and aryl amines, and sulfurized olefins. Commercial examples are CIBA L57 (phenyl amine) and ETHYL HITEC 1656.

Pour point depressants, either of polymethyl methacrylate or ethylene propylene olefin copolymer type are useful to decrease the low temperature Brookfield viscosity. Examples include Viscoplex 3008, Viscoplex 1-333 and LUBRIZOL 6662A.

Friction Modifiers are used to control friction and torque characteristics of the fluid. Commercial examples include LUBRIZOL 8650 and HITEC 3191.

The present invention can include defoamers such as polyalkymethacrylates, including polymethylmethacrylate. If added, they are typically at 0.02 to 0.5%. Defoaming agents include Nacol 2301, Munsing Foam Ban 159, HiTec 2030, Tego D515, Fomblin F-655 and Xiameter AFE-1430.

Other typical additives include additive packages (Add Pack) such as HiTEC 355, Anglamol 900IN, LZ A 6090H and HiTEC 3080; viscosity improvers (VI) such as HiTec 5738, HiTec 5760, Viscoplex 12-199 and SV603; seal swell agents (SSA) such as HiTEC 008; and friction modifiers (FM) such as XPDL886, Armolube 212, PV611 and Excel 95R; pour point depressants (PPD) such as Viscoplex 3008, Viscoplex 1-180 and dispersants such as HiTEC 5777, LZ 7177 and INF SV603. Viscoplex 12-199 is one of a group of compounds from Evonik, Darmstadt, Germany, known as comb polymers, which contain an acrylic copolymer. A feature of the comb polymer is that the molecule physically expands with increasing temperature.

The lubricant is formed by simply combining the components and mixing them until a homogenous liquid is obtained. The temperature and order of addition are not critical. The invention will be further appreciated in light of the following examples.

Five formulations for use in the present invention are listed in Table 1:

| | Formula 1 | Formula 2 | | Formula 3 |
|---|---|---|---|---|
| Group IV | 43.95 | 47.15 | Group III | 60.3 |
| HT5777 | 3.00 | 3.00 | VI 1 | 11.5 |
| VI1 | 12.30 | 8.30 | HT 5777 | 1.5 |
| Group V | 10.00 | 10.00 | VI 2 | 2 |
| Add Pack 1 | 10.00 | — | SSA | 8 |
| Add Pack 2 | — | 11.20 | Add Pack | 11.2 |
| Nanographite | 17.80 | 17.80 | Nanographite | 5 |
| VI2 | 2.50 | 2.50 | Silicone oil | 0.5 |
| Silicone oil | 0.5 | 0.5 | | |

| | Formula 4 | | Formula 5 |
|---|---|---|---|
| Group IV | 54.6 | Group III | 64.40 |
| VI 1 | 7.2 | VI 1 | 14.20 |
| HT 5777 | 1.5 | VI 2 | 2 |
| VI 2 | 2 | SSA | 8 |
| Group V | 10 | Add Pack | 11.2 |
| SSA | 8 | Defoamer | 0.10 |
| Add Pack | 11.2 | Silicone oil | 0.10 |
| Nanographite | 5 | | |
| Silicone oil | 0.5 | | |

Figure 2:
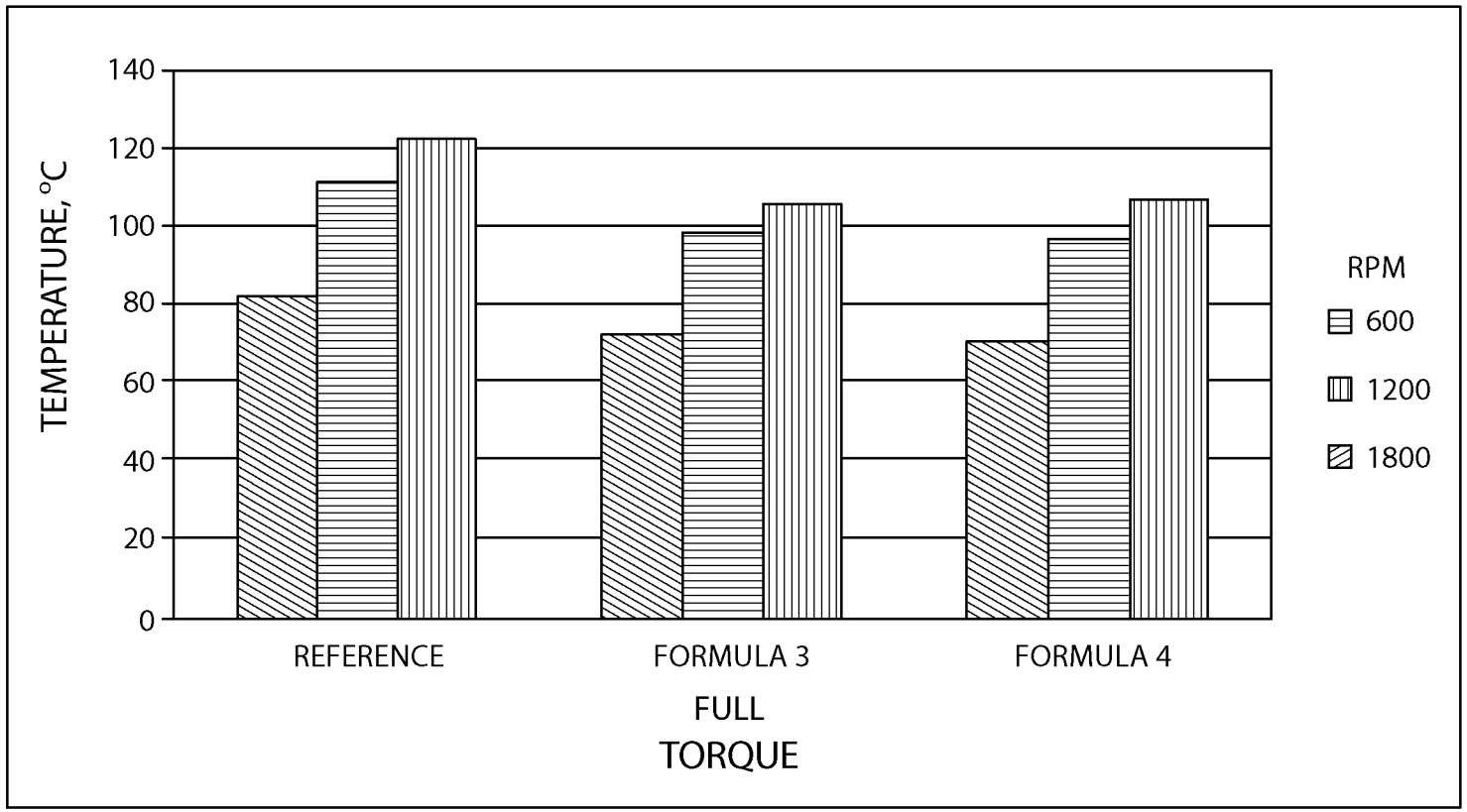
FIG. 2 is a chart showing the temperature comparison of formulations of the present invention versus a standard lubricant.

A reference lubricant formed from 64.6% group 3 base oil and an additive package similar to Formulas 3 and 5 was prepared. The reference lubricant did not include silicone oil or nanographite. FIG. 1 shows the efficiency of the reference lubricant versus formulas 1 and 2 at different shaft speeds. Formulas 1 and 2 significantly outperformed the reference lubricant. The surface tension of the reference lubricant was 28.91, whereas Formula 3 has a surface tension of 22.19 and Formula 5 has a surface tension of 24.28. The reference lubricant, as well as formulas 3 and 4, were subjected to a modified SAE J1266 axle test. The results of these tests are shown in FIG. 2. As shown, the gear oils of Formula 3 and 4 showed a temperature reduction of up to 16.37° C. These three lubricants were also tested for varying slide-roll ratios. Formulas 3 and 4 exhibited lower coefficients of friction than the reference lubricant.

A group IV-based reference lubricant was formed with a surface tension of 30.23 and compared with Formulas 1-5. Each oil was then tested for four slide-roll ratios and three temperatures at 1 GPa contact pressure. The reference oil had the highest friction coefficient. Formulas 2 and 4 gave a lower friction coefficient for low to medium entrainment speeds and all five formulas performed similarly.

Thus, by adding the silicone oil, the surface tension is reduced and the efficiency is improved. This works with all types of base oils, in particular Groups III and IV.

The following gear oils were formulated.

| | Formula 6 Nano Gear Oil | Formula 7 Nano Gear Oil with silicone |
|---|---|---|
| Group IV | 57.8 | 57.6 |
| Group V | 8 | 8 |
| VI 1 | 8 | 8 |
| HT 5777 | 1 | 1 |
| VI 2 | 2 | 2 |
| Group V | 10 | 10 |
| Add Pack | 11.2 | 11.2 |
| Nanographite | 2 | 2 |
| Silicone oil | | 0.05 |
| Defoamer | | 0.15 |
| Foam test ASTM D892 | | |
| Seq I 20/0 | 480/230 | 5/0 |
| Seq II 50/0 | 150/0 | 35/0 |
| Seq III 20/0 | 450/230 | 5/0 |
| Surface tension using the drop Shape Method | | |
| | 27.64 | 21.92 |

Formulas 6 and 7 are gear oil formulations which incorporate nano graphite particles. Formula 6 includes the nano graphite particles but without the silicone oil, the anti-foaming agent or the defoamer. Formula 7 includes silicone oil and the defoamers. Both formulations were tested for foaming according to ASTM D892 and the results are shown in the formulas below.

The following lubricants were formulated. Formula 9 included silicone oil.

| | Formula 8 Gear Oil 1 | Formula 9 Gear Oil 2 |
|---|---|---|
| Group III | 71.8 | 71.55 |
| SSA | 15 | 15 |
| VI | 5.7 | 5.7 |
| FM | 0.5 | 0.5 |
| Add Pack | 7 | 7 |
| Silicone oil | | 0.1 |
| Defoamers | | 0.15 |
| BV40 ** | 113600 | 72600 |

-continued

| | Formula 8 Gear Oil 1 | Formula 9 Gear Oil 2 |
|---|---|---|

** Brookfield viscosity @ −40 C.

These formulations demonstrate that the silicone oil can also affect the Brookfield viscosity. Formulas 8 and 9 were prepared using a Group III base oil. The formulations were the same except that Formulation 9 included the silicon oil and defoamers. These were then tested for Brookfield viscosity at −40° C. and the results are shown below the formulas.

Formulas 10 and 11 are similar to Formulas 8-9 but are formulated for use in manual transmissions and similar results are shown. The use of PPD has reduced BV40 around 8000, however, at BV55 the combination of silicone oil and defoamers showed a reduction.

| | Formula 10 Gear Oil 3 | Formula 11 Gear Oil 4 |
|---|---|---|
| Group III | 71.2 | 71.5 |
| SSA | 15 | 15 |
| VI | 5.5 | 5.5 |
| FM | 0.5 | 0.5 |
| PPD | 0.5 | 0.5 |
| Add Pack | 7 | 7 |
| Silicone oil | 0.05 | |
| Defoamers | 0.2 | |
| KV100 | 6.103 | 6.085 |
| Surface tension | 24.88 | 28.28 |
| BV40 | 8040 | 8300 |
| BV55 ** | 674000 | 1216000 |

** Brookfield viscosity @ 55 C.

Further, lubricant formulations of the present invention can also reduce power loss in pumps. In pump flow, fluid friction loss is defined as the loss of pressure or head due to the effect of the fluid's viscosity near the surface of the pump pipe. Reducing the surface tension helps to shear fluid more easily near the pipe's surface, reducing the power loss. This will help in improving the fluid flow to the different components of the engine or transmission where positive displacement pumps are used and will further improve pump life.

Thus, the present invention provides a lubricant with reduced surface tension due to the presence of silicone oil. In turn, the stability of the lubricant is enhanced by the incorporation of a dispersant into the formulation. This provides a lubricant that reduces energy loss.

This has been a description of the present invention along with the preferred method of practicing the present invention; however, the invention itself should only be defined by the appended claims wherein we claim:

What is claimed is:

1. A lubricant formulation comprising:

a base oil selected from a Group consisting of Group I, Group II, Group III, Group IV and Group V base oil and combinations thereof excluding silicone oil;

0.01 to 5% silicone oil which remains dispersed in said base oil, said silicone oil having a viscosity less than 10,000 cSt at 25° C., in an amount effective to decrease the surface tension of said lubricant formulation to less than 28 mN/m;

a dispersant olefin copolymer in an amount effective to maintain said silicone oil dispersed in said base oil, said olefin copolymer having a backbone polymer which is substantially linear and has less than 4 mole percent olefinic unsaturation, wherein said olefin copolymer is soluble in said base oil, a defoamer in a concentration of from 0.02 to 0.5%, and wherein said lubricant formulation produces foam test results using ASTM D892 of less than 50 mL foam in each of sequences I, II, and III, and a viscosity improver including a comb polymer.

2. The lubricant formulation claimed in claim 1 wherein said dispersant olefin copolymer is an ethylene propylene copolymer.

3. The lubricant formulation claimed in claim 2, wherein said dispersant olefin copolymer has an ethylene propylene ratio of 55/45-45/55.

4. The lubricant formulation claimed in claim 1, wherein said dispersant olefin copolymer is an ethylene propylene diene terpolymer.

5. The lubricant formulation claimed in claim 1, having 0.02 to 0.5% silicone oil.

6. The lubricant formulation claimed in claim 1, having 0.1 to 10% olefin copolymer.

7. The lubricant formulation claimed in claim 1, wherein said base oil is a Group III base oil.

8. The lubricant formulation claimed in claim 1, comprising 40-95% PAO.

9. The lubricant formulation claimed in claim 1, comprising 0.01 to 15% nanographite particles.

10. The lubricant formulation claimed in claim 1, wherein said base oil includes at least 40% of a Group III or Group IV base oil.

11. The lubricant formulation claimed in claim 5, comprising 40 to 95% by weight of said base oil.

12. The lubricant formulation claimed in claim 5, having a surface tension less than or equal to 25 mN/m.

13. The lubricant formulation of claim 1 wherein said polymer backbone includes at least 70% repeating Si—O groups.

14. The lubricant formulation of claim 1 wherein said silicone oil is selected from the group consisting of cyclopentasiloxane, dimethylpolysiloxane, and a mixture of dimethyl and methyl phenyl siloxanes.

15. The lubricant formulation of claim 1 wherein said defoamer is a polyalkylmethacrylate.

16. The lubricant formulation of claim 15 wherein said polyalkylmethacrylate is polymethylmethacrylate.

17. The lubricant formulation of claim 1 wherein said comb polymer contains an acrylic copolymer.

* * * * *